US011390406B2

(12) United States Patent
Van Winden et al.

(10) Patent No.: US 11,390,406 B2
(45) Date of Patent: Jul. 19, 2022

(54) STOPPER ASSEMBLY, USE OF A STOPPER ASSEMBLY

(71) Applicant: Vacu Vin Innovations Ltd., Gibraltar (GI)

(72) Inventors: Jasper Wilhelmus Petrus Van Winden, Gibraltar (GI); Rui Medeiros Santos, Gibraltar (GI)

(73) Assignee: Vacu Vin Innovations Ltd., Gibraltar (GI)

( * ) Notice: Subject to any disclaimer, the term of this patent is extended or adjusted under 35 U.S.C. 154(b) by 214 days.

(21) Appl. No.: 16/478,440

(22) PCT Filed: Jan. 16, 2018

(86) PCT No.: PCT/EP2018/050985
§ 371 (c)(1),
(2) Date: Jul. 16, 2019

(87) PCT Pub. No.: WO2018/130717
PCT Pub. Date: Jul. 19, 2018

(65) Prior Publication Data

US 2019/0375525 A1 Dec. 12, 2019

(30) Foreign Application Priority Data

Jan. 16, 2017 (NL) ..... 2018182

(51) Int. Cl.
*B65B 31/04* (2006.01)
*B65D 39/12* (2006.01)
(Continued)

(52) U.S. Cl.
CPC ..... *B65B 31/047* (2013.01); *B65D 39/12* (2013.01); *B65D 39/16* (2013.01); *B65D 47/247* (2013.01);
(Continued)

(58) Field of Classification Search
CPC ..... B65B 31/047; B65D 39/12; B65D 39/16; B65D 47/247; B65D 51/1644; B65D 81/2038
(Continued)

(56) References Cited

U.S. PATENT DOCUMENTS 1,087,840 A 2/1914 Simmons
2,735,566 A 2/1956 Bramming
(Continued)

FOREIGN PATENT DOCUMENTS

EP 0 234 607 A1 9/1987
EP 1 326 775 A1 7/2003
(Continued)

*Primary Examiner* — James N Smalley
(74) *Attorney, Agent, or Firm* — Kilpatrick Townsend & Stockton LLP

(57) ABSTRACT

Stopper assembly for a serving device configured to be positioned in a neck of a container, such as a bottle, wherein the stopper assembly comprises a body element arranged to fit in the serving device; a valve element mountable on the body element, wherein the body element extends substantially in a direction transverse to the valve element; and a handling element that is connectable to the valve element and extending in a direction substantially transverse to the valve element at an opposite side of the body element, such that the valve element is arranged in between the handling element and the body element.

17 Claims, 5 Drawing Sheets

Figure 1:
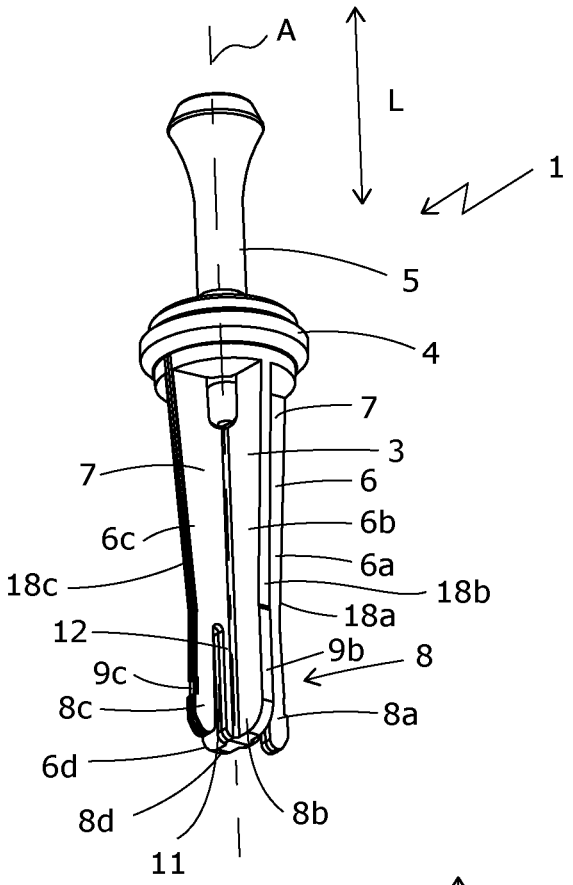

(51) Int. Cl.

| | |
|---|---|
| ***B65D 39/16*** | (2006.01) |
| ***B65D 47/24*** | (2006.01) |
| ***B65D 51/16*** | (2006.01) |
| ***B65D 81/20*** | (2006.01) |

(52) U.S. Cl.
CPC ..... *B65D 51/1644* (2013.01); *B65D 81/2038* (2013.01)

(58) Field of Classification Search
USPC ..... 215/262
See application file for complete search history.

(56) References Cited

U.S. PATENT DOCUMENTS

| | | | | |
|---|---|---|---|---|
| 5,031,785 | A * | 7/1991 | Lemme | B65B 31/047 215/228 |
| 5,535,900 | A * | 7/1996 | Huang | B65B 31/047 137/522 |
| 6,651,834 | B2 * | 11/2003 | Wong | B65D 79/0087 215/260 |
| 2015/0259186 | A1 * | 9/2015 | Haley | B67B 1/04 53/432 |

FOREIGN PATENT DOCUMENTS

| | | | |
|---|---|---|---|
| WO | 02/30782 | A1 | 4/2002 |
| WO | 02/032766 | A1 | 4/2002 |

* cited by examiner

STOPPER ASSEMBLY, USE OF A STOPPER ASSEMBLY

This application is the National Phase of International Application No. PCT/EP2018/050985, filed Jan. 16, 2018, which claims priority to the Netherlands Patent Application No. 2018182, filed Jan. 16, 2017, the disclosures of which are incorporated by reference herein.

The invention relates to a stopper assembly for a container, such as a bottle, to close off the liquid, such as wine, contained in the bottle from air.

Stoppers are known and are common used to close off a bottle of wine. The known stoppers are positioned in the neck of the bottle to close the neck of the bottle and to prevent air the liquid, such as wine, in the container, such as a bottle, from exposure to environmental air for saving the liquid contained in the container. In particular a valve stopper is known, such as described for example in WO 02/30782, EP 02340607 or EP 1326775, that works in cooperation with a vacuum pump. The valve stopper is positioned in the neck of a container and the vacuum pump can be placed on the valve stopper. By using the vacuum pump, air can be pumped out of the container, until a reduced pressure, also referred to as "vacuum" is obtained in the container with respect to the environmental pressure. When the air in the container is removed out of the container, by means of the vacuum pump in cooperation with the valve stopper, the liquid in the container is, during storage, not or barely exposed to air. Thus, the liquid, typically wine, can be kept longer once the container is opened, as the quality of the wine does not deteriorate due to contact with air in the bottle. The liquid in the container can thus be saved in a reliable way.

For serving the wine out of the bottle, various serving devices are known and used. The advantage of using a serving device, instead of pouring the liquid directly out of the container, is that dripping and/or leaking of the liquid may be prevented, and/or that the liquid flows smoothly out of the container into a recipient. Some serving devices are designed to induce swirling flow to aerate the wine while serving. Many variants are possible. The serving devices typically have a neck part that is inserted into the neck of the container. The neck part usually is made from a resilient material and/or has resilient ribs to ensure tight fitting of the neck part into the neck of the container. Typical serving devices also have a serving part extending from the neck part and out of the container, when the serving device is inserted in the container. The serving part may have various shapes designed to reduce dripping and/or the forming of droplets. Multiple serving devices are known.

The drawback for the user of all these devices is that the user requires multiple devices and needs to perform multiple handlings when he wants to pour liquid out of the bottle after closing off the bottle with a stopper. This is inconvenient and increases the risk of malfunctioning of each of the devices.

So, there is a need for an improved solution for storing and/or serving wine.

It is an object of the invention to provide for a stopper that alleviates at least one of the above mentioned drawbacks, preferably while maintaining the advantages.

Thereto, the invention provides for a stopper assembly for a serving device configured to be positioned in a neck of a container, such as a bottle, wherein the stopper assembly comprises a body element arranged to fit in the serving device; a valve element mountable on the body element, wherein the body element extends substantially in a direction transverse to the valve element; and a handling element that is connectable to the valve element and extending in a direction substantially transverse to the valve element at an opposite side of the body element, such that the valve element is arranged in between the handling element and the body element.

By providing a stopper assembly that is arranged for cooperation with the serving device, the serving device can be kept in the neck of the container and the container can be closed off by the stopper assembly. So, by using the stopper assembly in cooperation with the serving device, the user can use a single assembly for serving and storing of the liquid in the container.

By providing a valve element in the stopper assembly, air can be removed out of the container via the valve element, so improved saving of the liquid in the container can be possible. Preferably, air can be removed out of the container until a reduced pressure in the container is reached with respect to the environmental pressure, the so-called "vacuum", which may reduce deterioration of the liquid in the container. Such vacuuming of the container allows for improved saving of the liquid in the container, while, when the vacuum is undone, the liquid can be served out of the container via the serving device.

Advantageously, the valve element is arranged for cooperation with a vacuum pump. The vacuum pump to be used for cooperation with the valve element can be a known vacuum pump, or can be dedicated vacuum pump. Known vacuum pumps may require an adapter that is arranged for cooperation with the valve element at one side and with the vacuum pump at an opposite side.

In use, the stopper assembly is arranged in the serving device, that is fitted in the neck of the container, usually with its neck part. The body element of the stopper assembly fits in the serving device. As such, in use, the stopper assembly itself has no direct contact with the container, as between the container and the stopper assembly, there is positioned the serving device. Further, the valve element of the stopper assembly is, in use, mounted on an upper side of the body element, while a lower side of the body element extends towards an inside of the container. The handling element, that is, in use, connected to the valve element, extends in a direction substantially transverse to the valve element, such that the valve element is between the handling element and the body element. Therefore, in use, the handling element can be reached and touched by a user, so that the user can manipulate the handling element.

When the stopper assembly is arranged in the serving device, the stopper assembly is adjustable with respect to the serving device between a serving position in which the stopper assembly allows for liquid passing through and being served via the serving device and a storage position, in which the stopper assembly closes off the serving device and prevents liquid from passing through. The stopper assembly is adjustable between the storage position and the serving position by pushing or pulling the handling element in a direction substantially transverse with respect to the valve element. This direction substantially coincides with a direction along a longitudinal axis of the stopper assembly. The stopper assembly is then moved up or down with respect to the serving device, thus the stopper assembly is being moved along its longitudinal axis. So, by providing the stopper assembly in the serving device, the user does not need to exchange devices for serving and closing off the liquid in the container.

The valve element of the stopper assembly is adjustable between an open position allowing air to pass through the valve element and a closed position in which the valve element sealingly engages with the body element for preventing air to pass through. The valve element can be adjusted between the open position and the closed position by the handling element that can be operated by a user. Preferably, when the valve element is in the closed position, and the stopper assembly is in the storage position, air can be sucked out of the container by means of a vacuum pump that cooperates with the valve element to obtain a reduced pressure in the container with respect to the environmental pressure for vacuuming of the container. The valve element is configured to open and close under influence of a pumping action of a vacuum pump. So, advantageously, the stopper assembly can be used for serving the liquid out of the container, for closing off the liquid in the container as well as for saving the liquid in the container by providing a reduced pressure in the container. This provides a significant advantage for the user, as he does not have to exchange multiple devices for serving the liquid, typically wine, storing it in the bottle by using a stopper or saving it during storage by using a valve stopper. All these functions can now be performed with a single stopper assembly, that in use is provided in a serving device, and that can cooperate with a vacuum pump. The serving device and the stopper assembly can remain in the container as long that there is liquid in the container that can be served and/or stored and/or saved.

Advantageously, the body element of the stopper assembly has ribs to provide channels along which the liquid can be served. When the stopper assembly is in the serving position, it is moved somewhat out of the serving device, so the channels formed by the ribs are opened and liquid can flow through and can flow onto the serving part of the serving device for a drip-free and/or smooth serving.

The body element preferably comprises engagement elements for engagement with the serving device. The engagement elements can be provided at an underside of the ribs and provide for a stop position when pulling the stopper assembly to the serving position somewhat out of the serving device. The engagement elements then prevent the stopper assembly from being pulled away too far and thus from removing of the stopper assembly out of the serving device when adjusting the stopper assembly from the storage position to the serving position.

Advantageously, the valve element, body element and handling element of the stopper assembly are removable connectable with respect to each other. This is advantageous for cleaning and maintenance. For example, the valve element can comprise an opening through which the handling element can be connected. The handling element can for example comprise a first end extending through the opening of the valve element towards the body element and can comprise a second end extending in opposite direction away from the valve element. The handling element is preferably rod shaped or otherwise elongated such that it can be easily operated and reached for by a user. The first end of the handling element can be arranged to cooperate with an upper side of the body element, such that, when pushing the handling element downwards towards the body element, the valve element can be adjusted to the closed position, until the first end abuts against the upper side of the body element. When pushing further downward, the stopper assembly can be adjusted to the storage position.

Advantageously, the handling element is connectable to the valve element under pretension. Then, the handling element is more sealingly engaged to the valve element to prevent air from leaking along the connection between the handling element and the valve element.

Further advantageous embodiments are represented in the subclaims.

The invention further relates to a method for storing liquid, a method for vacuuming liquid, a method for serving liquid. The invention further relates to the use of a stopper assembly for storing, serving and vacuuming liquid. The invention further relates to a kit of a stopper assembly and a serving device and/or a vacuum pump.

The present invention will be further elucidated with reference to a drawing.

Figure 2:
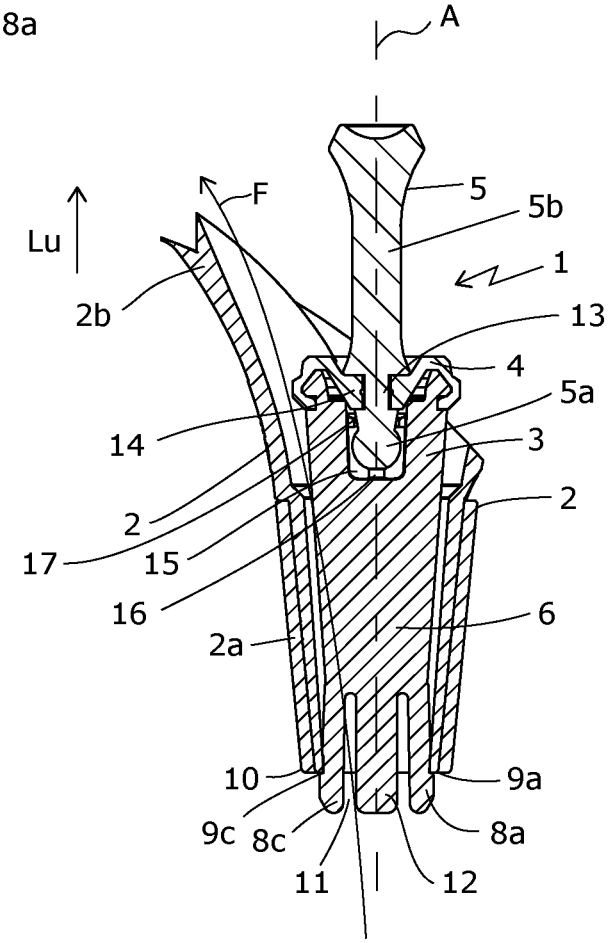
Figure 3:
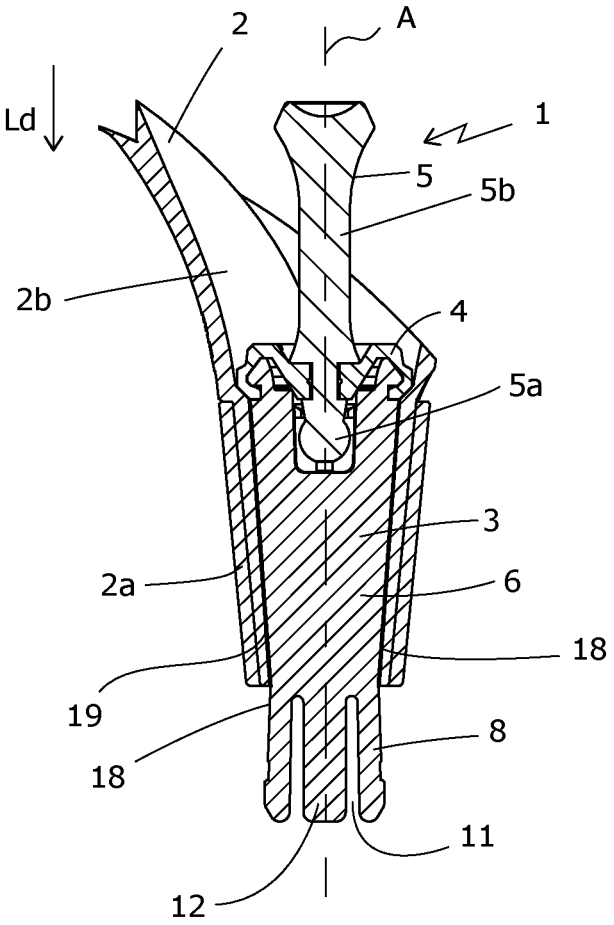
Figure 4:
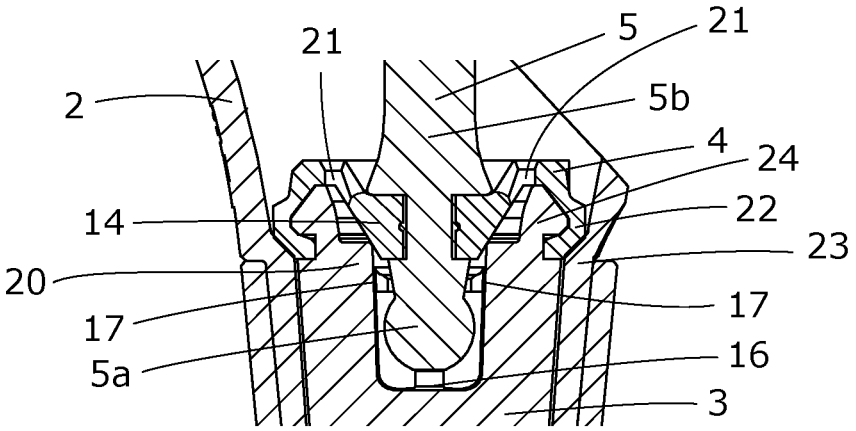
Figure 5:
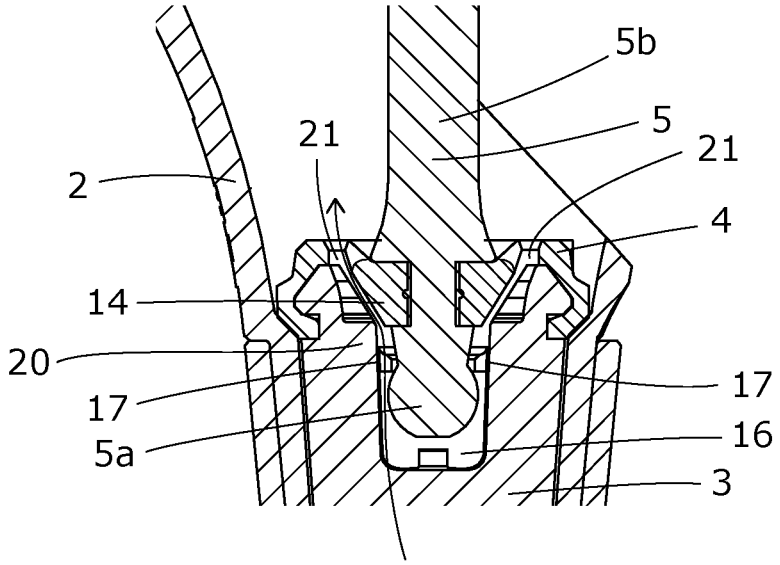
Figure 6:
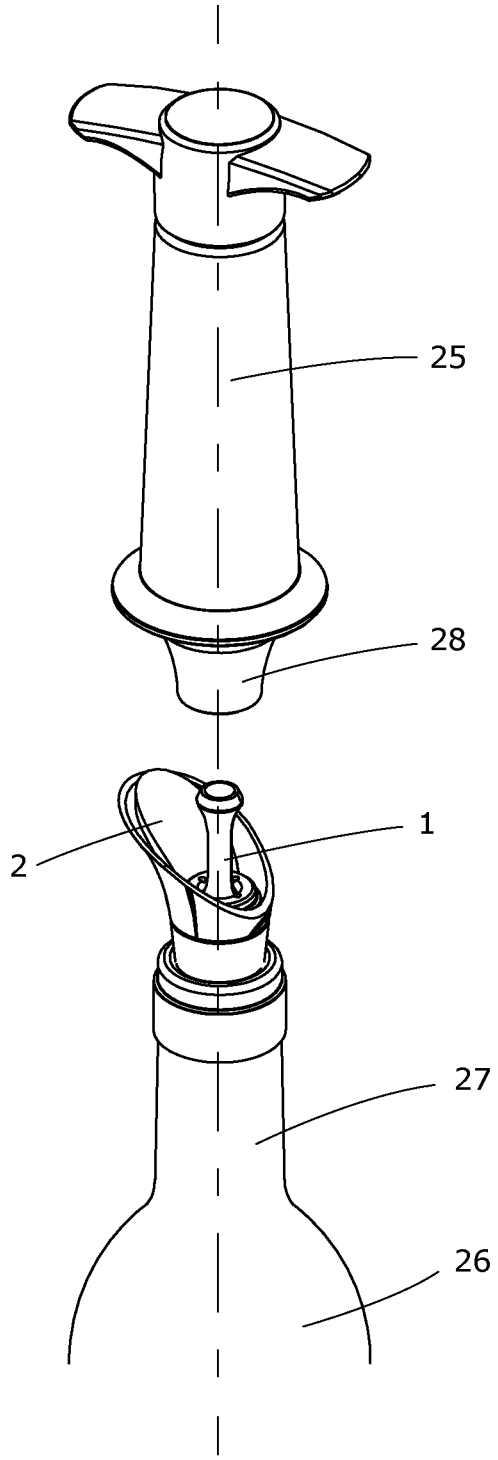
Figure 7:
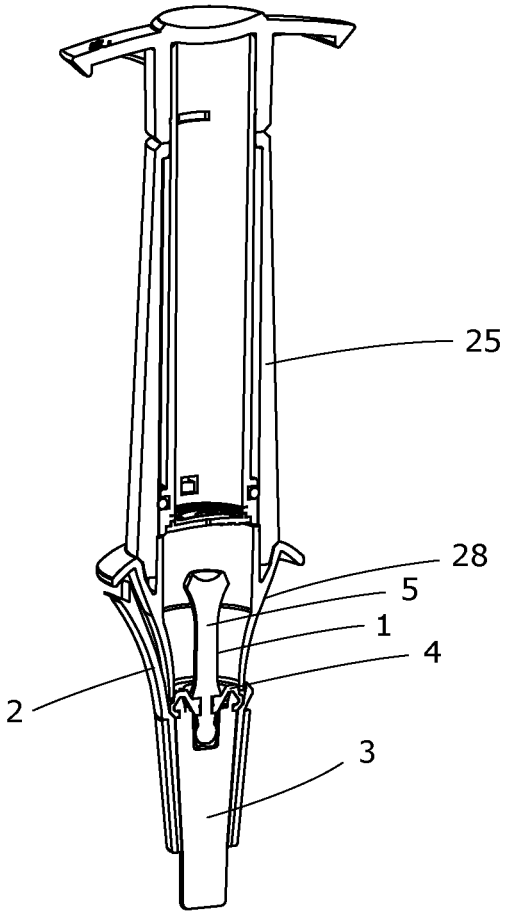
Figure 8:
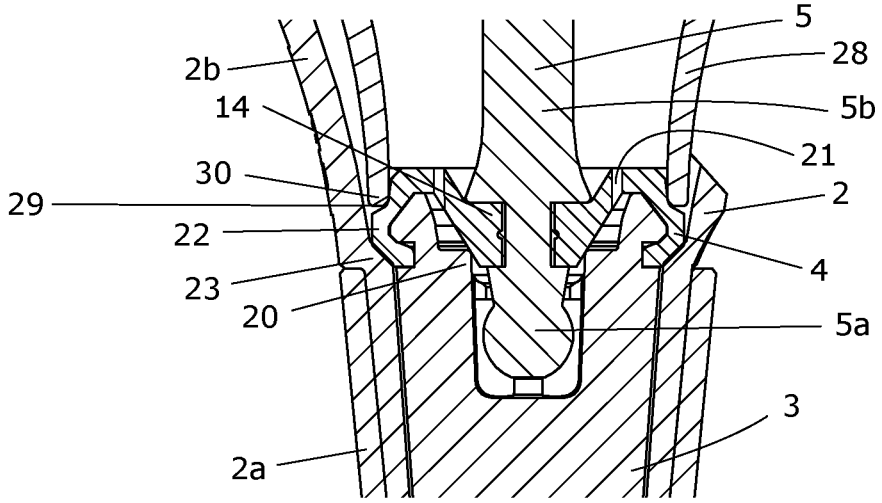

In the drawing shows:

FIG. 1 a schematic perspective view of a stopper assembly according to the invention;

FIG. 2 a schematic cross-section of the stopper assembly received in a serving device with the stopper assembly in the serving position;

FIG. 3 a schematic cross-section of the stopper assembly received in a serving device with the stopper assembly in the storing position;

FIG. 4 a schematic cross-section of a detail of the stopper assembly showing the valve element in closed position;

FIG. 5 a schematic cross-section of a detail of the stopper assembly showing the valve element in open position;

FIG. 6 a schematic perspective exploded view of the stopper assembly received in a serving device mounted in a bottle and a vacuum pump;

FIG. 7 a schematic cross-section of the stopper assembly with a serving device and a vacuum pump; and FIG. 8 a schematic cross-section of a detail of the stopper assembly showing the valve element with an adapter for the vacuum pump mounted on the valve element.

In the drawing, the figures are given merely as a schematic representation of the invention. Corresponding elements are designated with corresponding reference signs.

FIG. 1 shows a stopper assembly 1 arranged to be positioned in a serving device 2, as shown in FIG. 2. The stopper assembly 1 comprises a body element 3 that is configured to fit in the serving device 2. Further, the stopper assembly 1 comprises a valve element 4 that is mountable onto the body element 3. As can be seen in FIG. 1, and also in FIG. 2, the body element 3 extends in a direction substantially transverse to the valve element 4. The stopper assembly 1 extends in a longitudinal direction L along a longitudinal axis A. The body element 3 mainly extends in the longitudinal direction L along the longitudinal axis A away from the valve element 4. The stopper assembly 1 also comprises a handling element 5 that is connectable to the valve element 4. The handling element 5 is an elongated element and extends substantially in the longitudinal direction L of the stopper assembly 1, in opposite direction of the body element 3. The valve element 4 is thus arranged between the body element 3 and the handling element 5.

The body element 3 comprises ribs 6. Here, four ribs 6*a*, 6*b*, 6*c*, 6*d* are provided for the body element 3. The ribs 6*a*-6*d* are arranged in a cross-shape. Between two adjacent ribs 6*a*, 6*b*; 6*b*, 6*c*; 6*c*, 6*d* and 6*d*, 6*a*, a channel 7 is formed through which liquid can flow. At an end 8 of the body element 3, opposite the valve element 4, the body element 3 is provided with engagement elements 9 for engagement with the serving device 2. The engagement elements 9 are here provided as a cutout in the ribs 6*a*-6*d*. The engagement elements 9*a*-9*d* can provide for a clamping engagement with a lower end 10 of the serving device 2, as shown in FIG. 2. The engagement elements can also be embodied differently, e.g. as a protrusion which can cooperate with the serving device, or as a clickfinger or any other engagement element. The engagement element 9 functions as a stop to prevent the stopper assembly 1 to be pulled upwards through the serving device 2. On the other hand, the stopper assembly 1 is removable from the service device 2 by moving opposite ribs 6*a*, 6*c* or 6*b*, 6*d* towards each other at the lower end 8 of the body element 3. To allow the lower ends 8*a*-8*d* to be resiliently movable, an undercut 11 is provided in each of the ribs 6*a*-6*d* between the lower ends 8*a*-8*d* and a central part 12. By moving the opposite lower ends 8*a*, 8*c* or 8*b*, 8*d* of the ribs 6*a*, 6*c* or 6*b*, 6*d* respectively towards each other, the engagement of the engagement elements 9*a*-9*d* with the service device 2 can be undone, and the stopper assembly 1 can be removed from the service device 1. This can be advantageous for cleaning and/or maintenance.

In FIG. 2, the stopper assembly 1 is received in the serving device 2. The service device 2 has a neck part 2*a* that is configured to be inserted in a neck of a container, such as a neck of a bottle. The neck part 2 is preferably at least partly made from resilient material to tightly fit into the neck of a container to prevent leakage of air and/or fluid between an outer surface of the service device 2 and an inner surface of the neck of the container. The service device 2 further may be provided with a service part 2*b*, that is here shown as a tapered end of the service device of which one side is substantially longer than an opposite side to induce liquid to along the longer side of the service part 2*b*. Further, the service part 2*b* is here provided with sharp edges to prevent dripping and/or leakage. Here, there is shown a double sharpened edge with a groove inbetween, such that, even when droplets would be formed, the droplets are captured in the groove and do not fall of the service part 2*b*. It may be apparent for the skilled person that many service devices are available and possible to be used in cooperation with the stopper assembly.

As can be seen in FIG. 2, the valve element 4 comprises an opening 13 through which the handling element 5 is connectable. The opening 13 is advantageously positioned centrally in the valve element 4. The handling element 5 has a first end 5*a* extending through the opening 13 of the valve element 4 towards the body element 3, and has a second element 5*b* extending in opposite direction away from the valve element 4. The first end 5*a* and the second end 5*b* of the handling element 5 extend in a direction approximately transverse to the valve element 4, substantially in longitudinal direction L of the stopper assembly 1. Due to the central position of the opening 13, the handling element 5 extends substantially along the longitudinal axis A of the stopper assembly 1. The longitudinal axis A coincides with the central axis of the stopper assembly 1. The stopper assembly 1 is preferably symmetrical with respect to a plane through the longitudinal axis A.

Around the opening 13, the valve element 4 has a collar 14. The handling element 5 fits through the opening 13 under pretension of the collar 14. This provides for a more tight fitting of the handling element 5 with respect to the valve element 4, such that leakage of air and/or liquid along this connection between the handling element 5 and the valve element 4 through the opening 13 is prevented as much as possible, preferably completely.

The first end 5*a* of the handling element 5 is here provided as a ball shaped element 5*a* that is received in a recess 15 of the body element 3. In the recess 15 a seat 16 is provided against which the ball element 5*a* can abut. Of course, the seat 16 can be obviated and the ball element 5*a* can abut against a bottom of the recess 15. Further, in the recess 15, here stop members 17 are provided that prevent the ball shaped element 5*a* from moving further upward out of the recess 15. The stop members 17 can be embodied as rings protruding inwardly from a wall of the recess 15, as also shown in FIG. 4.

The valve element 4 is clampingly engaged with an upper end 20 of the body element 3. For example the body element 3 can be provided with a click finger 24 around which the valve element 4 can be clamped. Thus, the valve element 4 can be removable connected to the body element 3.

By providing the handling element 5 as an elongated element, extending in a longitudinal direction away from the valve element 4, the handling element 5 can be relatively easily reached and/or operated by a user, even when the stopper assembly is inserted in a serving device 2.

By operating the handling element 5, the stopper assembly 1 can be adjusted between a serving position, as shown in FIG. 2, and a storage position, as shown in FIG. 3. In the serving position, the stopper assembly 1 is moved upwardly with respect to the serving device 2 in longitudinal direction Lu until the engagement elements 9*a*-9*d* engage with the lower end 10 of the serving device 2 and prevent the stopper assembly 1 from moving further upward. An inside of the container is then in fluid connection with the environment via the channels 7 and liquid can flow via the channels 7 onto the serving device 2 into a recipient, when tilting the container provided with the serving device 2 and the stopper assembly 1, as illustrated with arrow F.

By pushing the handling element 5 downwardly, along the longitudinal axis A towards the body element 5, or when mounted in a container towards an inside of the container, the stopper assembly 1 is moved with respect to the serving device 2 in longitudinal direction Ld. The stopper assembly 1 is moved in direction Ld until the valve element 4 abuts against the serving device 2, as shown in FIG. 3. The channels 7 of the body element 3 are then closed off, and liquid cannot pass along the channels 7 out of the container. The body element 3 then fits in the neck part 2*a* of the serving device 2. Preferably, an outer wall 18*a*-18*d*, see also FIG. 1, of the ribs 6*a*-6*d* has a shape corresponding to the shape of an inner wall 19 of the serving device 2, such that, in the storage position of the stopper assembly 1 with respect to the serving device 2, the body element 3 tightly fits into the neck part 2*a* of the serving device 2 to prevent liquid and/or air from passing therethrough.

The valve element 4 itself is also adjustable between an open position allowing air to pass through the valve element 4, and a closed position preventing air from passing through the valve element 4. In FIG. 4, the valve element 4 is shown in closed position. The collar 14 of the valve element 4 sits on an upper end 20 of the body element 3. As such, air is prevented to pass between the body element 3 and the valve element 4. The valve element 4 is provided with holes 21. In the closed position of the valve element 4, as shown in FIG. 4, air is prevented to pass through the holes 21 in or out of the container due to the sealing engagement of the collar 14 onto the upper end 20 of the body element 3. Also, in the storage position of the stopper assembly 1, a shoulder 22 of the valve element 4 sealingly engages with a shoulder 23 of the serving device 2 to seal the connection between the valve element 4 and the serving device 2. In the open position of the valve element 4, as shown in FIG. 5, the collar 14 of the valve element 4, the collar 14 is at a distance of the upper end 20 of the body element 3, such that air can pass through there through and then through the holes 21 of the valve element 4. Due to the pretension in the collar 14 of the valve element 4, the collar 14 is biased towards the closed position of the valve element 4.

By operating the handling element 5, the stopper assembly 1 can be adjusted between the storage position and the serving position and/or the valve element 4 can be adjusted between the open position and the closed position.

When the stopper assembly 1 is in the serving position, as shown in FIG. 2, the handling element 5 can be pushed downward in a direction Ld by a user to the storage position as shown in FIG. 3. The handling element 4 is moved downward until the first end 5*a* of the handling element 5 abuts against, here seat 16, of the recess 15 of the body element 3, as in the normal closed position of the valve element 4, there is a distance between the ball shaped end 5*a* and the seat 16 of the recess 15. The collar 14 now tightly sits onto the upper end 20 of the body element 3. By pushing the handling element 5 further downward, the stopper assembly 1 as a whole is moved in direction Ld until the stopper assembly 1 is tightly engaged with the serving device, for example due to a tight fitting of the body element 3 with the serving device and/or due to the valve element 4 sitting on a shoulder 23 of the serving device 2. Then the storage position as shown in FIG. 3 is reached.

The valve element 4 can be adjusted from the closed position, shown in FIG. 4, to the open position, as shown in FIG. 5, by operating the handling element 5. By pulling somewhat on the handling element 5 in a direction Lu, the pretension of the collar 14 can be overcome, and the collar 14 can be lifted somewhat upwardly. There is then a distance between the collar 14 and the upper end 20 of the body element 3 forming a passage through which air can flow via the openings 21 into and/or out of the container. The ball shaped end 5*a* is also at a distance of the seat 16 of the recess 15. The handling element 5 can be pulled upwardly in direction Lu until the ball shaped element 5*a* abuts against the stop members 17, here protruding rings. This is important when there is an under pressure, or so-called "vacuum" in the container and/or to suck air out of the container to obtain an under pressure. When there is an under pressure in the container, by lifting the handling element 5, and thus the collar 14, the vacuum can be undone. By further pulling the handling element 5 in the direction Lu, the stopper assembly 1 can be moved to the serving position, in which, when tilting the container, liquid can be poured out of the container via the channels 7 and the serving device 2.

By using a vacuum pump 25 that can cooperate with the stopper assembly 1, in particular with the valve element 4, air can be sucked out of the container. The functioning of the vacuum pump 25 is understood to be known by the skilled person and will not elaborated further here. FIG. 6 shows a general arrangement of a container 26 having a neck 27 in which a serving device 2 is mounted. In the serving device 2, the stopper assembly 1 is mounted. The vacuum pump 25 is arranged for cooperation with the stopper assembly 1, here via an adapter 28. Alternatively, the vacuum pump 25 may be dedicated for cooperation with the stopper assembly 1, such that an adapter 28 may be obviated.

FIG. 7 shows a cross-section of the vacuum pump 25 in cooperation with the stopper assembly 1, with FIG. 8 showing a detail of the valve element 4 in cooperation with the vacuum pump 25, via adapter 28. The adapter 28 is arranged to fit onto the valve element 4. The valve element 4 is thereto provided with a receiving seat 29 on which a lower edge 30 of the adapter 28, or, alternatively of the vacuum pump, can sealingly engage. This connection between the adapter 28 and the valve element 4 is preferably sealingly closed such that air sucked out of the container by the pump 25 does not leak away via this connection. In order that the vacuum pump 25 can effectively suck air out of the container to reduce the pressure in the container with respect to the environmental pressure, so-called "vacuuming" of the container, other the connections of the stopper assembly 1 are preferably sealingly engaged as well to prevent leakage of air. As explained above, the connection of the serving device 2 itself with the neck of the container is preferably tightly fitting, due to the resilience of the material of the neck part 2*a* of the serving device 2. Also, the connection between the serving device 2 and the stopper assembly 1, via the shoulder 22 of the valve element 4 resting on the shoulder 23 of the serving device 2 is tightly fitted, and is being sealed more due to the reduction of the pressure in the container during pumping. The shoulder 23 is preferably inclined. This inclined orientation of the shoulder 23 provides for a self-sealing of the stopper assembly 1 when the pressure in the container reduces with respect to the environmental pressure. Similarly, the underside of the collar 14 is inclined, such that, due to a reduced pressure in the container, the collar 14 more effectively pulls itself onto the upper end 20 of the body element 3. Due to the use of inclined surfaces, even under environmental pressure, these surfaces provide for a more or less airtight connection. With a reduced pressure in the container, the connections at these surfaces are, so to say, actively sealed. Further, due to the pressure a user is putting onto the vacuum pump when pumping, the adapter 28 is pushed onto the seat 29, and the shoulder 22 is pushed onto the shoulder 23, and the stopper assembly 1 with the serving device 2 is pushed further into the neck of the container, such that these connections are more airtight sealed during pumping. After the reduced pressure, or "vacuum" is established in the container, these connections remain sealed airtight due to the under pressure in the container with respect to the environmental pressure outside of the container. Due to the pretension of the collar 14, the connection of the handling element 5 through the valve element 4 is air tight, and this connection as well, is additionally sealed when there is under pressure in the container.

To provide under pressure in the container, air is being sucked out of the container by the vacuum pump 25 via the valve element 4. With each pumping movement, in particular with a sucking movement of the pump 25, the valve element 4, more particularly the collar 14 is moved upward. The collar 14 is then lifted from the upper end 20 of the body element 3 opening a passage through which air can flow towards the openings 21 in the valve element 4. This lifting of the valve element 4 becomes possible when the pressure above the valve element 4 is lower than the pressure below the valve element 4 plus the pretension in the valve element 4. The valve element 4 is preferably made from a plastic, more or less resilient material, and hinge lines may be provided around which e.g. the collar 14 can move. After the required under pressure is reached in the container, the vacuum pump 25 can be removed from the stopper assembly 1, as then the connections are being sealed additionally by the under pressure. To undo the vacuum in the container, a user can lift the handling element 5 upward, and thus lift the collar 14 from the upper end 20 of the body element, opening the air passage towards the openings 21 again for allowing air in and/or out of the container.

For the purpose of clarity and a concise description, features are described herein as part of the same or separate embodiments, however, it will be appreciated that the scope of the invention may include embodiments having combinations of all or some of the features described. It may be understood that the embodiments shown have the same or similar components, apart from where they are described as being different.

In the claims, any reference signs placed between parentheses shall not be construed as limiting the claim. The word 'comprising' does not exclude the presence of other features or steps than those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to an advantage. Many variants will be apparent to the person skilled in the art. All variants are understood to be comprised within the scope of the invention defined in the following claims.

The invention claimed is:

1. A system comprising:

a stopper assembly; and a serving device configured to be positioned in a neck of a container, wherein the stopper assembly comprises:

a body element positioned within the serving device;

a valve element coupled to the body element, wherein the body element extends away from the valve element in a first direction, and wherein the valve element is movable relative to the body element between an open position and a closed position; and a handling element coupled to the valve element and extending in a second direction opposite the first direction such that the valve element is arranged in between the handling element and the body element, wherein the valve element defines an opening through which the handling element is coupled to the valve element, and wherein the stopper assembly is configured to be adjustable with respect to the serving device between a storage position in which the stopper assembly engages with the serving device to close off the serving device to prevent liquid from passing through the serving device, and a serving position in which the stopper assembly is moved with respect to the serving device to allow liquid to flow through the serving device.

2. The system according to claim 1, wherein the body element comprises ribs configured to provide for channels along which liquid can be poured out of the container around the stopper assembly.

3. The system according to claim 1, wherein the body element comprises a plurality of resilient ribs, wherein the plurality of resilient ribs each comprise an engagement element, wherein opposite ribs of the plurality of resilient ribs are configured to be movable toward each other from a first configuration to a second configuration, and wherein the engagement elements are configured to engage with the serving device with the plurality of resilient ribs in the first configuration in order to prevent the stopper assembly from being removed from the serving device and configured to not engage with the serving device with the plurality of resilient ribs in the second configuration in order to allow the stopper assembly to be removed from the serving device.

4. The system according to claim 1, wherein the valve element is configured to be transitioned between the open position wherein air is allowed to pass through the stopper assembly between the valve element and the body element, and the closed position wherein the valve element sealingly engages with the body element preventing air to pass through the stopper assembly.

5. The system according to claim 4, wherein the handling element is configured to allow a user to transition the valve element between the open position and the closed position.

6. The system according to claim 4, wherein the first end of the handling element is received through the opening of the valve element under pretension so that air cannot pass through the opening.

7. The system according to claim 4, wherein the valve element comprises a collar extending around the opening configured for receiving the first end of the handling element.

8. The system according to claim 7, wherein in the open position of the valve element, the collar is at a first distance of an upper end of the body element, and in the closed position of the valve element, the collar contacts the upper end of the body element.

9. The system according to claim 4, wherein the body element defines a recess arranged for receiving the first end of the handling element.

10. The system according to claim 1, wherein the valve element comprises a shoulder configured to sealingly engage with the serving device in the storage position to prevent liquid from passing through the serving device.

11. The system according to claim 1, wherein the handling element is configured to allow a user to transition the stopper assembly between the storage position and the serving position, such that, by pushing the handling element towards the body element, the stopper assembly is moved towards the storage position, and by pulling the handling element away from the body element, the stopper assembly is moved towards the serving position.

12. The system according to claim 1, further comprising an adapter configured for cooperation with a vacuum pump at one side and configured for cooperation with the valve element at an opposite side.

13. A method for storing liquid in a container with the system of claim 1, comprising:

inserting the serving device into a neck of the container;

inserting the stopper into the serving device; and adjusting the stopper assembly to a storage position with respect to the serving device, with the valve element in a closed position.

14. A method for vacuum sealing liquid, in a container with the system of claim 1, comprising:

inserting the serving device into a neck of the container;

inserting the stopper assembly into the serving device;

adjusting the stopper assembly to a storage position with respect to the serving device;

providing a vacuum pump with an adapter, configured for cooperation with the valve element of the stopper assembly;

positioning the vacuum pump with the adapter onto the valve element; and pumping with the vacuum pump until an under pressure is reached in the container.

15. A method for pouring liquid out of a container with the system of claim 1, comprising inserting the serving device into a neck of the container;

inserting the stopper assembly into the serving device;

adjusting the stopper assembly to a serving position with respect to the serving device;

tilting the container to pour liquid out of the container along the stopper assembly and the serving device.

16. A method of use of the system according to claim 1 for saving, serving and vacuum sealing liquid, in a container.

17. A kit comprising:

The system of claim 1; and a vacuum pump configured for cooperation with the stopper assembly.

* * * * *